United States Patent [19]

Hisatake et al.

[11] Patent Number: 4,774,899

[45] Date of Patent: Oct. 4, 1988

[54] SPEED SETTING DEVICE FOR AN ELECTRIC SEWING MACHINE

[75] Inventors: Michio Hisatake, Kanagawa; Satoru Ishikawa, Tokyo, both of Japan

[73] Assignee: Janome Sewing Machine Co. Ltd., Tokyo, Japan

[21] Appl. No.: 118,239

[22] Filed: Nov. 6, 1987

[30] Foreign Application Priority Data

Nov. 7, 1986 [JP] Japan ..... 61-263675

[51] Int. Cl.[4] ..... D05B 69/36

[52] U.S. Cl. ..... 112/277; 112/275

[58] Field of Search ..... 112/277, 275, 121.11, 112/121.12, 121.15; 318/369, 371, 375

[56] References Cited

U.S. PATENT DOCUMENTS

| | | | |
|---|---|---|---|
| 4,137,860 | 2/1979 | Yoneji et al. | 112/275 X |
| 4,331,890 | 5/1982 | Makino et al. | 112/277 X |
| 4,401,042 | 8/1983 | Hanyu et al. | 112/277 X |
| 4,554,879 | 11/1985 | Eguchi | 112/277 X |
| 4,630,212 | 12/1986 | Shigeta | 112/277 X |
| 4,648,339 | 3/1987 | Fujikawa | 112/277 |
| 4,693,197 | 9/1987 | Tami | 112/121.11 X |

*Primary Examiner*—H. Hampton Hunter

*Attorney, Agent, or Firm*—Michael J. Striker

[57] ABSTRACT

A flat touch switch having plural switch components with rotation speeds of the sewing machine shaft indicated on each component is positioned in the region of the needle bar. Pushing a component part of the switch drives the machine at the indicated speed. A control logic circuit senses the pushed component and by sensing the speed of the driven shaft, drives the machine at the selected speed.

5 Claims, 7 Drawing Sheets

Vcc
R1
R2
R3
R4
INV4
INV3
INV2
INV1
P1
P2
P3
P4
SW1
SW2
SW3
SW4
Q
3
AND 7
AND 6
AND5
AND4
AND3
AND 2
AND1
INV 11
INV 13
INV 15
INV 17
INV 12
INV 14
INV 16
AND 8
ORI
DRI
DS
TO FIG. 3B
CIRCUIT DETECTING POWER SUPPLY

Vcc
R1
R2
R3
R4
INV4
INV3
INV2
INV1
P1
P2
P3
P4
SW1
SW2
SW3
SW4
Q
3
AND7
AND6
AND5
AND4
AND3
AND2
AND1
INV 11
INV 13
INV 15
INV 17
INV 12
INV 14
INV 16
AND8
TO FIG. 6B
ORI
MM
DRI
CIRCUIT DETECTING POWER SUPPLY
DS

FIG_7

| Switch (Pushed switch is O) | | | | Set flip-flop | Output value of decoder (Address value) | Set rotation number (r. p. m) |
|---|---|---|---|---|---|---|
| SW1 | SW2 | SW3 | SW4 | | | |
| × | × | × | O | FF7 | 7 | 800 |
| × | × | O | O | FF6 | 6 | 700 |
| × | × | O | × | FF5 | 5 | 600 |
| × | O | O | × | FF4 | 4 | 500 |
| × | O | × | × | FF3 | 3 | 400 |
| O | O | × | × | FF2 | 2 | 300 |
| O | × | × | × | FF1 | 1 | 200 |
| When a switch is pushed in a couple other than the above | | | | FF0 | 0 | 100 |
| During pushing a switch | | | | — | 0 | 100 |

SPEED SETTING DEVICE FOR AN ELECTRIC SEWING MACHINE

FIELD OF THE INVENTION

The present invention relates to a speed control device for a motor of an electric sewing machine, and more particularly to a speed setting device therefor.

BACKGROUND OF THE INVENTION

In an electric sewing machine having so-called hand controller system which is provided with a speed selecting device for a machine motor and a stop device, there are embodiments, where a machine body is, as shown in FIG. 4, provided with switches of low speed, middle speed, high speed and a stop switch (these switches are exclusive of one another), or where a machine body is, as shown in FIG. 5, provided with switches for in advance selecting low speed, middle speed and high speed (these switches are exclusive of one another) and a switch located near a needle bar of the sewing machine to designate the drive or stop of the motor.

The former embodiment has the stop switch, and an operator must confirm therewith a switch to be pushed when stopping the machine motor. The latter embodiment requires the two operations for selecting speed and stop.

SUMMARY OF THE INVENTION

The present invention provides a flat switch having a plurality of switch components arranged in line and marked with rotation speed numbers on an outer surface thereof, in a region of the needle bar of the sewing machine. Pushing on any component part of the flat switch will designate the drive or stop of the machine motor. A control logic circuit (which realizes a program in accordance with this invention) is designed such that, after initiating the drive, a constant rotation speed of an upper shaft of the sewing machine corresponds to the rotation number shown at a position of the pushed component part, and the machine motor is stopped by pushing any component part of the flat switch, and therefore it is not necessary to confirm it by an additional operation. The switch has the speed selection and the drive stop designed for easy operation.

BRIEF DESCRIPTION OF THE DRAWINGS

FIG. 2(*b*) is a sectional side view of the flat switch of FIG. 2(*a*);

FIG. 7 shows a table of set rotation speed numbers when a switch component part is pushed.

DETAILED DESCRIPTION OF THE INVENTION

Embodiments of the invention will be explained with reference to the attached drawings.

Figure 1:
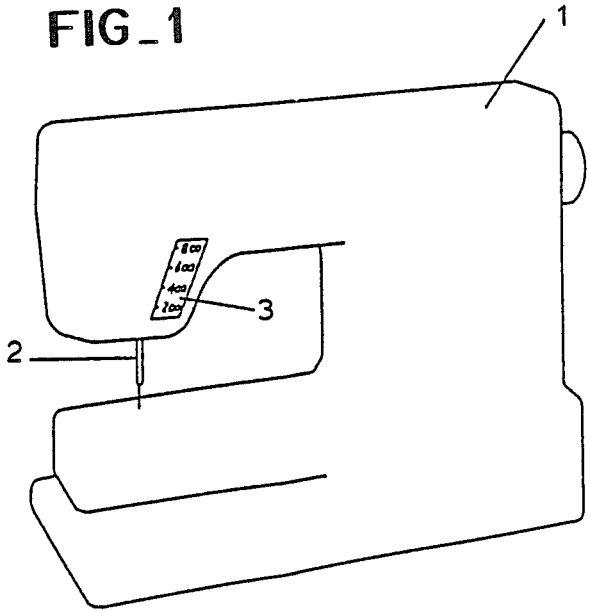
FIG. 1 is a perspective view of an electric sewing machine embodying the invention.

FIG. 1 shows the sewing machine provided in a place near to a needle bar 2 at a head 1 of the sewing machine with a flat or membrane-type switch 3 (called as "switch" hereinafter) having switch components formed in line. The switch is marked on its outer surface with numbers indicative of the speed of rotation of a non-illustrated upper shaft of the sewing machine.

Figure 2A:
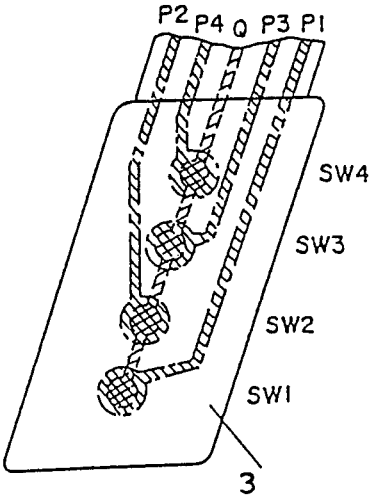
FIG. 2(*a*) is a front view of a flat switch in the machine of FIG. 1.
Figure 2B:
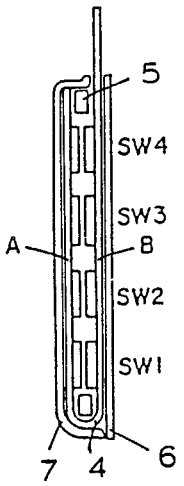

FIG. 2(*a*) shows the switch 3 having four switch components SW1 to SW4 disposed vertically in line. As shown in the cross sectional view of FIG. 2(*b*), a U-shaped resilient sheet 4 keeps an insulation sheet 5 therebetween to separate the contacts of respective switch components. The rear side B is protected by a reinforcing plate 6, and an outer sheet 7 printed with rotation speed numbers is attached by an adhesive to the front side A of sheet 4. The outer sheet 7 in a film and is bendable by a finger pushing so that A side and B side of the sheet 4 is deformed to close selected switch components. When the finger is released, the sheet 4 resumes its original shape due to its elasticity, and contacts on the A and B sides are again separated by the thickness of the insulation sheet 5.

In the illustrated embodiment, the switch 3 is composed of four aligned switch components (SW1), (SW2), (SW3), (SW4). By pushing an intermediate part of outer sheet 7 between (SW1) and (SW2) for example, both switch components are closed, and the B side of the elastic sheet 4 is extended to a base (not shown) of a speed controller and connected thereto via a connector.

Figure 3A:
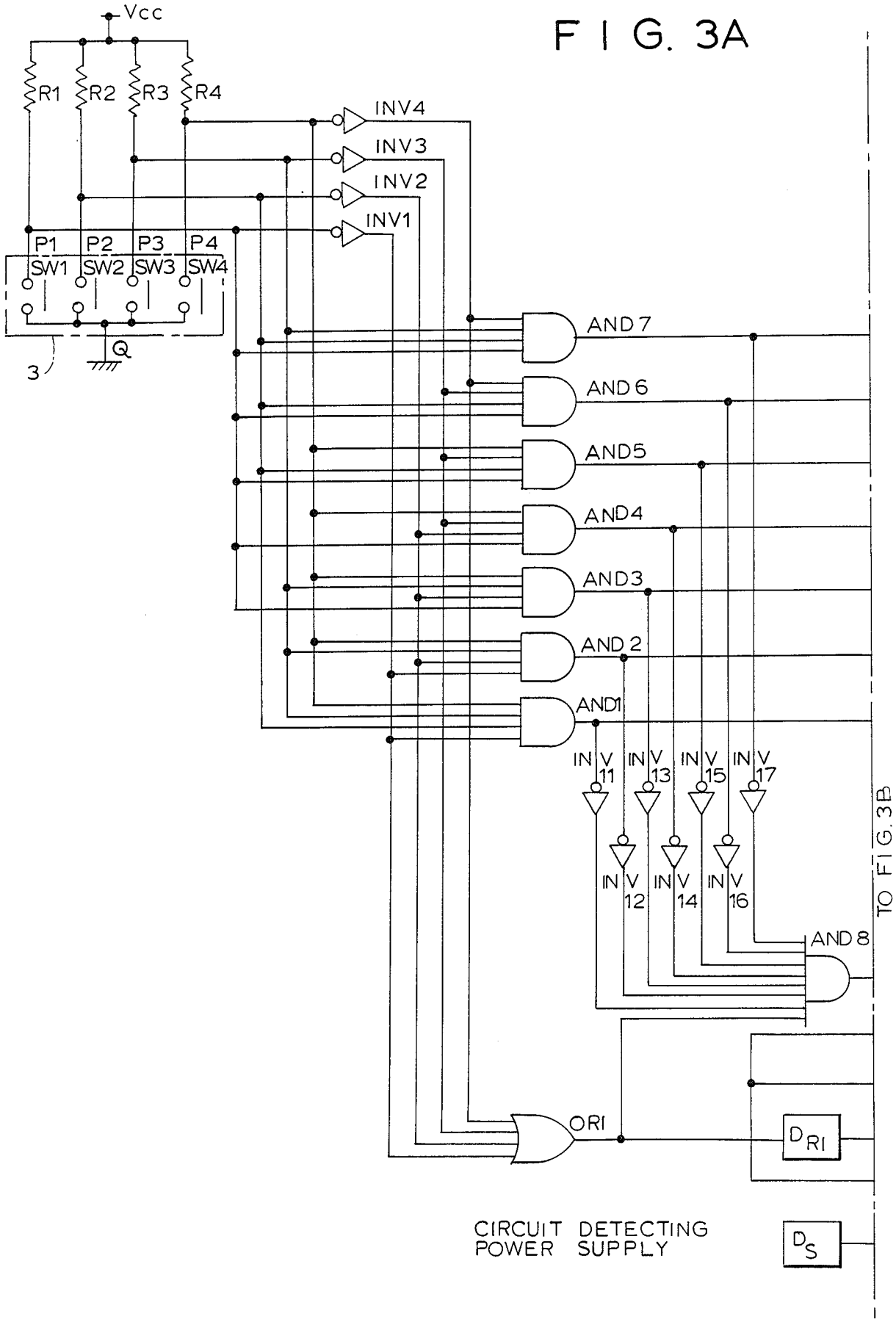
FIG. 3A is connection with FIG. 3B illustrate a block diagram showing a first embodiment of the control circuit according to the invention.
Figure 3B:
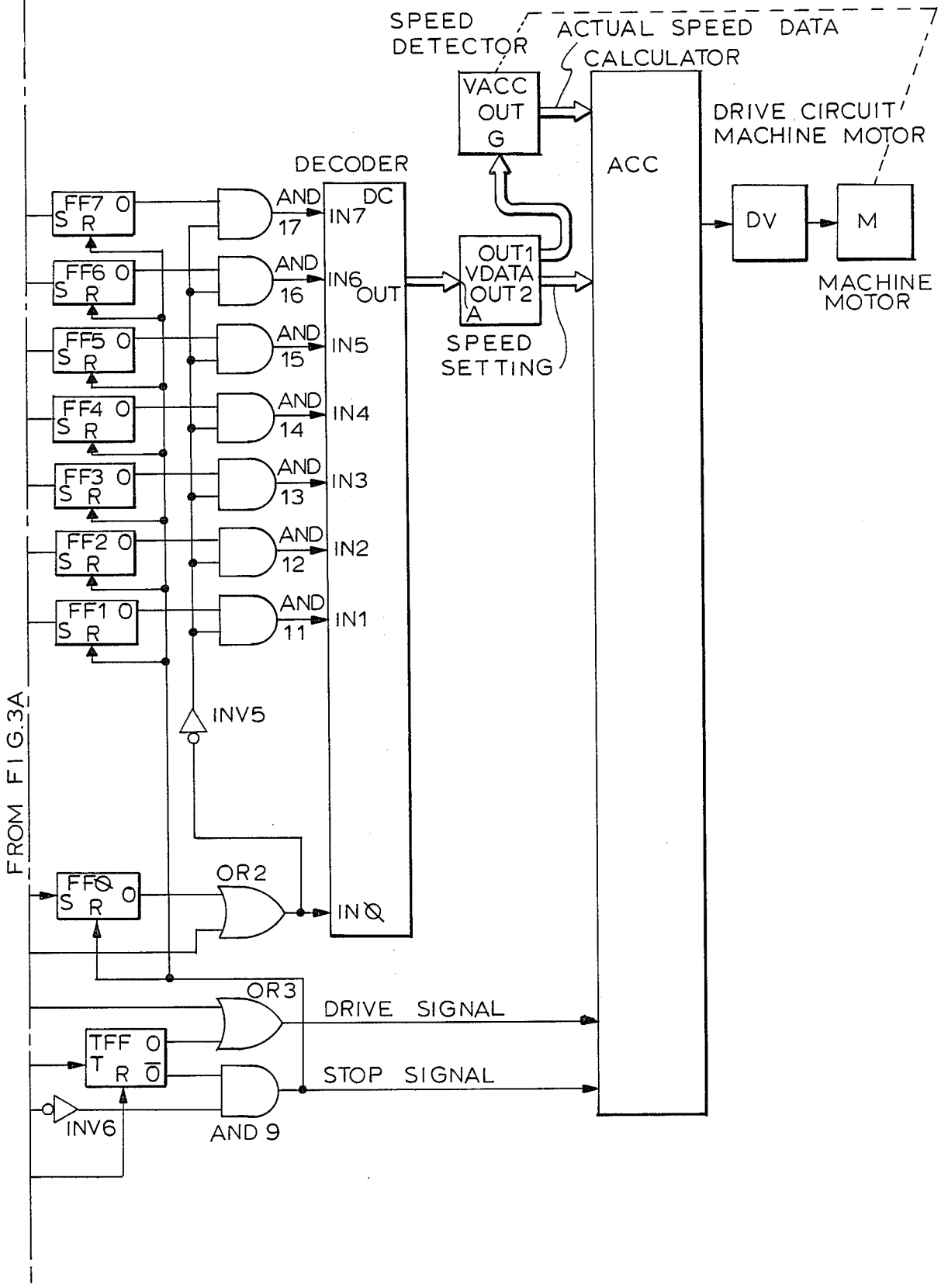
Figure 4:
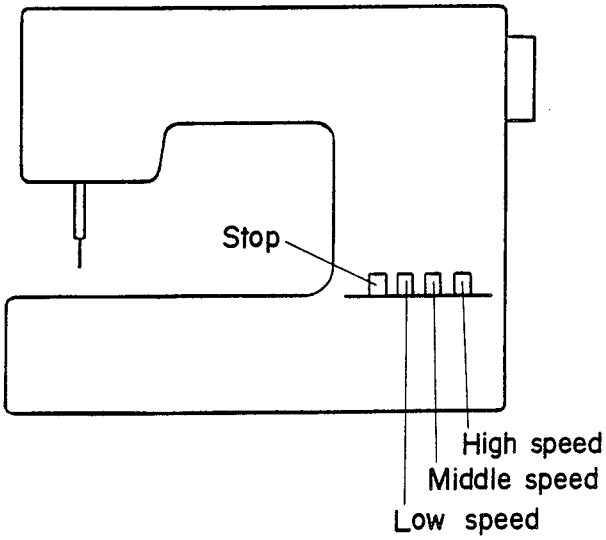
FIGS. 4 and 5 are front views of electric sewing machines having conventional hand operated controller systems.
Figure 5:
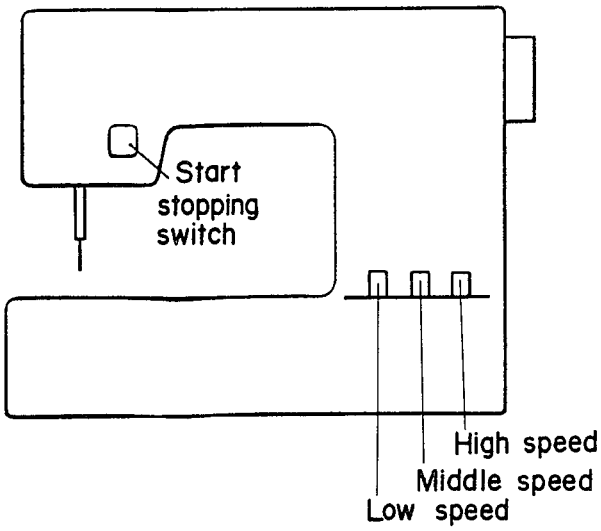

FIG. 3 is a block diagram of a control logic circuit of this invention, and main parts of relative controls are realized by a program of a micro computer.

A speed setting data store or memory (VDATA) supplies at its output terminal (OUT2) speed sitting data addressed by an input terminal (A) to a calculator (ACC), and also supplied at its output terminal (OUT1) data (speed reading-in cycle data) designating cycle number of a speed detecting signal to a speed detecting device (CACC).

The speed detecting device (VACC) keeps detecting rotation speed number of an upper shaft of the sewing machine and counts clock pulses (from a oscillator, now shown) in several cycles of the speed signals, and gives the clock count as actual speed data to the calculator (ACC).

When a "H" drive signal is issued, the calculator (ACC) controls conduction time of a semi-conductor element in a machine drive circuit (DV) by the above mentioned speed setting data and actual speed data, and feeds back so that the upper shaft is set at a designated rotation speed number. Detailed description of this operation is taught in Japanese Pat. No. 8789 (Laid Open Jan. 16, 1987).

The speed setting data memory (VDATA) stores speed read-in cycle data and speed setting data whose address values are 100 rpm, 200 rpm, 300 rpm . . . 800 rpm in response to 0, 1, 2 . . . 7.

T type flip-flop (TFF) inverts its output Q each time when its input terminal (T) is supplied with a pulse.

(TFF) is reset by a source signal detecting circuit (Ds) when a source pulse is supplied, and Q output is at L level and Q is at H level. (DR1) is a rise detecting circuit, and if any one of the switches (SW1) and (SW4)

is pushed and a corresponding pulse from the power source is supplied via resistors R1–R4, inverters (INV1) to (INV4), OR gate (OR1) and (DR1) to the input terminal (T) of the T type flip-flop (TFF), and the output of (TFF) is inverted. The output signal of OR gate (OR3) is a drive signal to operate the calculator (ACC) and drive the machine motor (M). The drive signal is output by OR gate (OR3) when any one of the switches (SW1) to (SW4) is pushed and when the output Q of (TFF) is H. An output signal of AND gate (AND9) is a stop signal to stop the calculator (ACC) and the machine motor (M). The stop signal is issued when Q output of (TFF) is H and when the switch 3 is not pushed and no pulse is applied to OR gate (OR1) and inverter (INV6).

AND gates (AND1) to (AND7) and flip-flops (FF1) to (FF7) are means which discriminate which component part of switch 3 has been pushed.

AND gate (AND8) and flip-flop (FFO) are means for disciminating and storing signals generated when more than one of the four switch components (SW1) to (SW4) of the switch 3 has been pushed, or the adjacent two switch component parts are pushed and corresponding pulses are applied to OR gate (OR1) and inverters (IN11) to (IN17), that is, for example, when three switch component parts are pushed or alternate two component parts are pushed.

When the input terminals (IN0) to (IN7) are H, the decoder (DC) in response to these high levels gives an address value to the speed setting data memory (VDATA). OR gates (OR1) (OR2), the inverter (INV5) and AND gates (AND11) to (AND 17) are logic means which designate the low speed rotation to the decoder (DC). When the switch 3 is pushed, only the input terminal (IN0) of the decoder (DC) is H, and the flip-flops (FF0) to (FF7) are reset by the stop signal.

The set rotation speed numbers (rpm) when the switch 3 is pushed are shown in the table of FIG. 7.

The actuation of the speed setting device will be explained below with reference to the structure of FIG. 3.

(a) Supply of the source signals

Before actuation of the switch 3, the T type flip-flop (TFF) is reset (Q is L) by the source signal detecting circuit (DS), and its $\overline{Q}$ output terminal is H. Since the switch 3 is not pushed, the output of OR gate (OR1) is L, and the stop signal is issued from the output terminal of AND gate (AND9) to stop the calculator (ACC) and the machine motor (M). The flip-flops (FF0) to (FF7) are reset by the stop signal.

(b) Pushing simultaneously two switch components, e.g. (SW2) and (SW3)

After pushing switch components (SW2) and (SW3), the output of the OR gate (OR1) changes from L to H, the T type flip-flop (TFF) is supplied with a source pulse at its input terminal (T) via the rise detecting circuit (DR1), and its output is inverted such that Q is H level and $\overline{Q}$ is L level. The drive signal from (OR3) is applied to the calculator (ACC) and the machine motor (M) is started. Only the input terminal (IN0) of decoder (DC) is set to H level by or gate (OR2), and via the inverter (INV5) the AND gates (AND11) to (AND17) are reset. The decoder (DC) gives the address value "0" to the speed setting data memory (VDATA). The speed setting data equivalent to 100 rpm is applied to the calculator (ACC), and the speed read-in cycle data is applied to the speed detecting device (VACC). Then, the upper shaft of the sewing machine is rotated at 100 rpm. Since (SW2) and (SW3) are pushed, the output of AND gate (AND4) is H, and only the flip-flop (FF4) is set and its output Q is H level.

(c) Releasing of (SW2) and (SW3)

Upon releasing the switch components (SW2) and (SW3), the output of OR gate (OR1) is L level, and since the flip-flop (FF0) is not set, the output of the inverter (INV5) is H level. Therefore, only the input terminal (IN4) of the decoder (DC) is H level, and the decoder (DC) gives the address value "4" to the speed setting data memory (VDATA), and the speed setting data equivalent to 500 rpm is given to the calculator (ACC) and the speed read-in cycle data is given to the speed detecting device (VACC). Then, the upper shaft is rotated at 500 rpm.

(d) Pushing of a single switch component only, e.g. (SW2)

When pushing any of the switch components, the output of OR gate (OR1) changes from L to H, the output of the T type flip-flop (TFF) is inverted, and $\overline{Q}$ is L level and Q is H level. Consequently, the stop signal is not issued via the inverter (INV6) and AND gate (AND9), and the drive signal is continuously issued by OR gate (OR3). Since OR gate (OR1) is H level, the input terminal (IN0) of the decoder (DC) is H level, and the upper shaft is rotated at 100 rpm as long as the (SW2) is pushed and the flip-flop (FF3) is set.

(e) Releasing of (SW2)

Since OR gate (OR1) is reset to L level, the stop signal is issued to stop the calculator (ACC) and the machine motor (M). The flip-flops (FF3) (FF4) are reset.

As having stated above, the flat switch 3 has a plurality of the switched components disposed vertically in line, and is provided in a region of head 1 near the needle bar 2. When switch 3 is pushed, the drive and stop are designated alternately, and by selecting a pushing position, the set rotation number may be selected in seven steps.

Figure 6A:
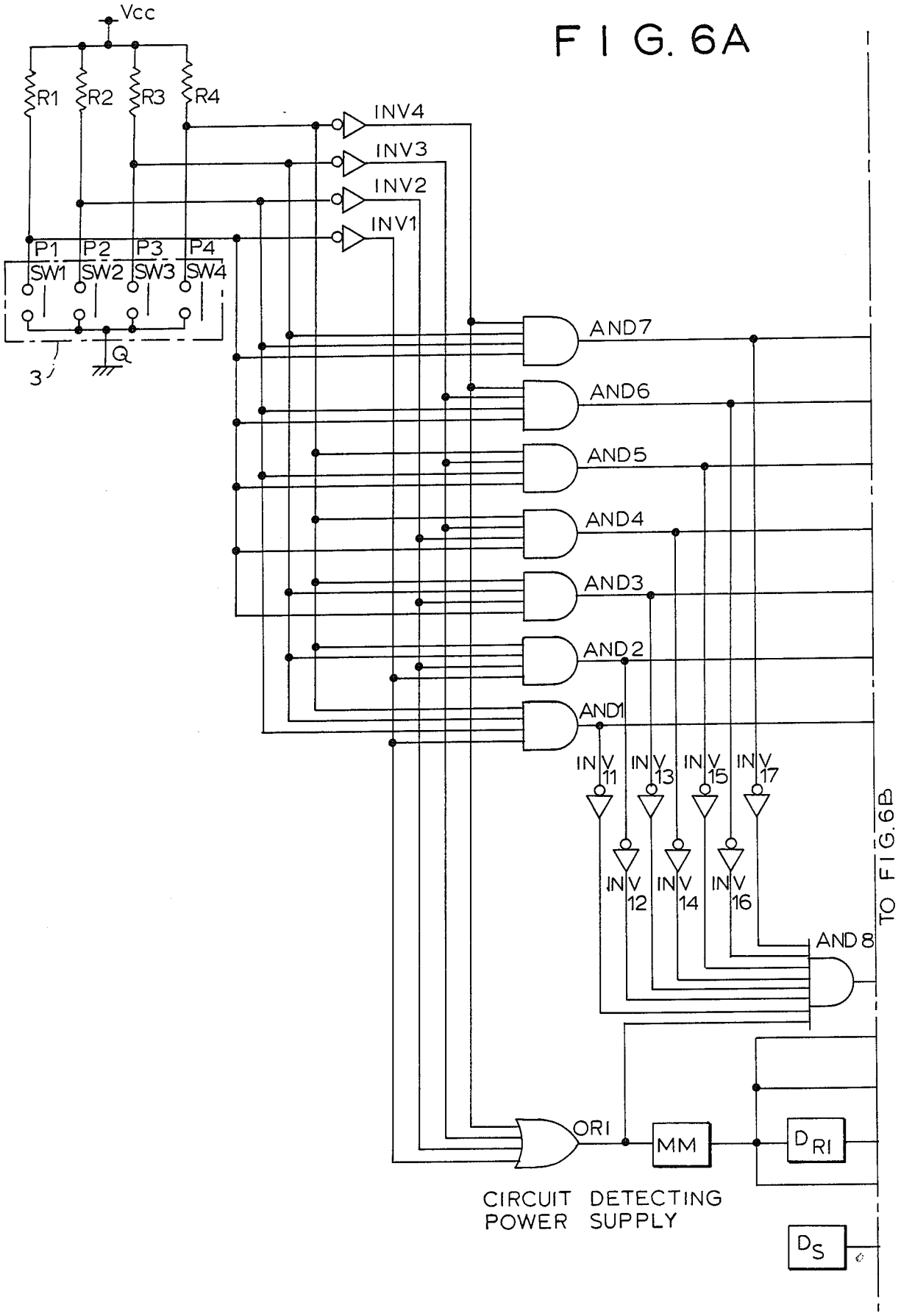
FIG. 6A in connection with FIG. 6B illustrate a block diagram showing a second embodiment of the control circuit according to the invention.
Figure 6B:
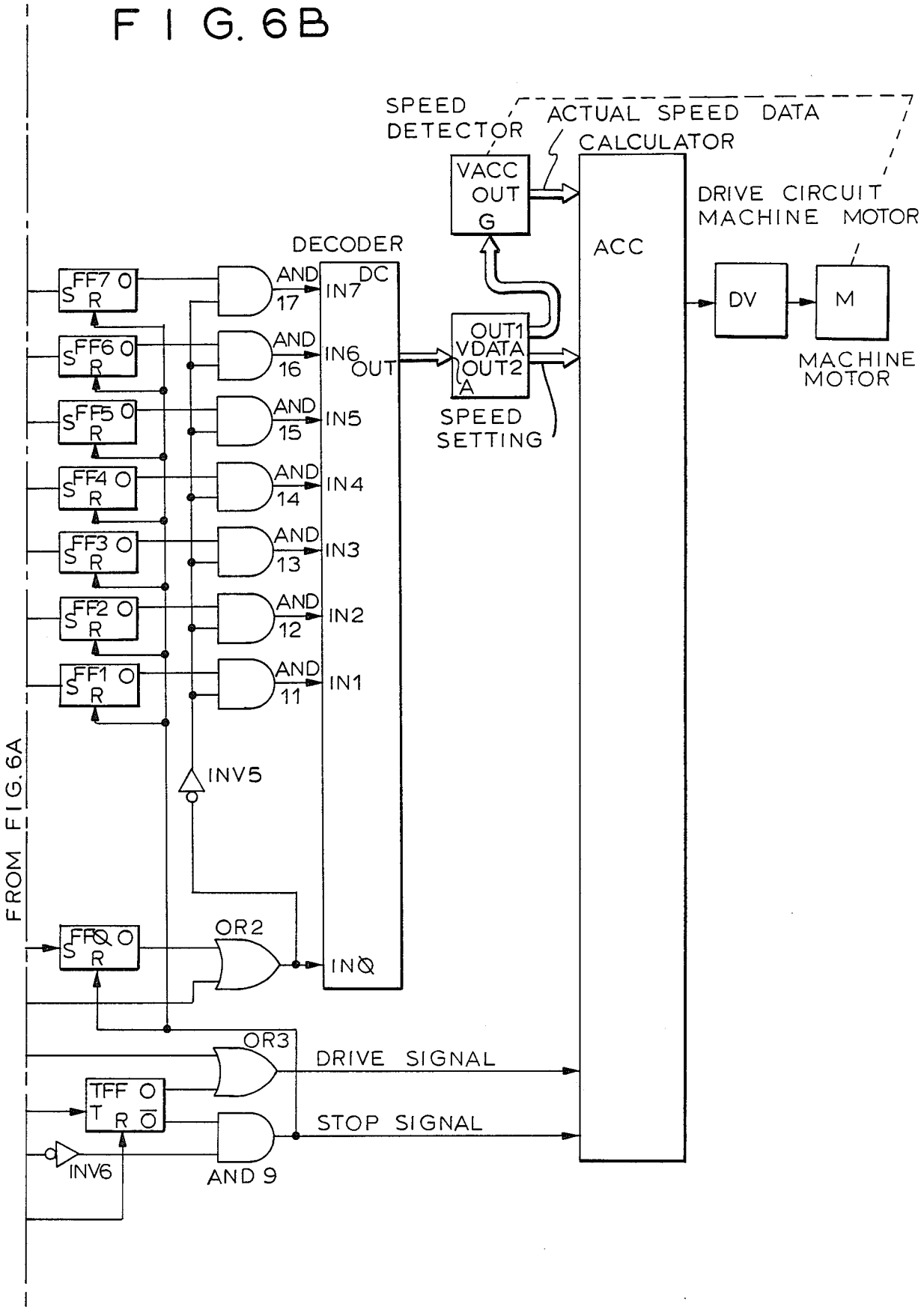

FIG. 6 illustrates an embodiment where a delay means (MM) is added between (OR1) and DR1 of FIG. 3. The delay means (MM) delays by a delay time T (about 1 second) the switching time of L to H, but "H to L" is switched over together with the output of OR gate.

In such a manner, if the speed is changed during driving the machine motor, a desired speed indicating position of the switch 3 is pushed in a time shorter than the above mentioned T time.

What is claimed is:

1. A speed setting device for an electric sewing machine having an electric motor for rotating an upper shaft of the machine, a drive circuit for controlling ignition voltage applied to the motor, a speed setting data memory for storing designated rotation speed number data, a speed detecting device for detecting speed of rotation of the upper shaft, and a calculator for controlling conduction time of a semi-conductor element in said drive circuit to control driving of said motor at a rotation speed number designated to the upper shaft by actual speed data from the speed detecting device and speed setting data from the speed setting data memory, said speed setting device comprising a plurality of switches disposed in line at a region near a needle bar of the sewing machine, said switches being actuated for a desired speed of operation by a finger pushing and recovering its original shape when released, a state setting means for designating drive and stop of the machine motor each time of said actuation, a means for discriminating a pushed switch and storing a corresponding discriminating signal, a decoder for decoding said discriminating signal to provide an addressing value of a location of the speed setting data memory where corresponding speed setting data is stored, and a logic means for discriminating simultaneous pushing of at least two switches and storing a corresponding discriminating signal to designate rotation at low speed.

2. The device as claimed in claim 1, wherein a delay means is positioned in relation with the state setting means for designating drive and stop of the machine motor, and is stopped when the operation time of the switch is longer than delay time of the delay means, and changes the speed designation without changing the state setting means if it is shorter, so that the speed changing is possible during driving.

3. The device as claimed in claim 1 where an indication device is provided around said switch for showing set speed.

4. The device as claimed in claim 2, where an indication device is provided around said switch for showing set speed.

5. A speed setting device for an electric sewing machine having an electric motor for rotating an upper shaft of the machine, means for adjusting rotational speed of the motor, and means for stopping the motor, comprising a membrane-type switch having a series of finger operated switching components arranged on said sewing machine, a logic circuit for controlling said adjusting means in response to the actuation of respective switching components to set predetermined operative conditions, said logic circuit designating different constant rotational speeds in response to the actuation of single switching components, to the simultaneous actuation of a group of switching components, and further designating a common low speed in response to the subsequent release of an actuated group of switching components, or stopping said motor in response to the subsequent release of an actuated single switching component.

* * * * *